US009327316B2

(12) United States Patent
Goel et al.

(10) Patent No.: US 9,327,316 B2
(45) Date of Patent: May 3, 2016

(54) MULTI-FREQUENCY ACOUSTIC ARRAY

(75) Inventors: Atul Goel, Fort Collins, CO (US); Osvaldo Buccafusca, Fort Collins, CO (US); Steven Martin, Fort Collins, CO (US); Joel Philliber, Fort Collins, CO (US); R. Shane Fazzio, Eden Prairie, MN (US)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 1121 days.

(21) Appl. No.: 12/494,847

(22) Filed: Jun. 30, 2009

(65) Prior Publication Data

US 2010/0327695 A1 Dec. 30, 2010

(51) Int. Cl.
*G10K 9/125* (2006.01)
*B06B 1/06* (2006.01)

(52) U.S. Cl.
CPC ..... *B06B 1/0611* (2013.01); *B06B 1/0622* (2013.01)

(58) Field of Classification Search
USPC ..... 310/320, 324
See application file for complete search history.

(56) References Cited

U.S. PATENT DOCUMENTS

| | | | | |
|---|---|---|---|---|
| 2,875,355 | A | 2/1959 | Petermann | |
| 2,943,278 | A | 6/1960 | Mattiat | |
| 2,976,501 | A | 3/1961 | Mattiat | |
| 3,384,767 | A | 5/1968 | Arnold et al. | |
| 4,129,799 | A | 12/1978 | Green | |
| 4,529,904 | A | 7/1985 | Hattersley | |
| 4,868,446 | A | 9/1989 | Kumada | |
| 4,985,926 | A | 1/1991 | Foster | |
| 5,587,620 | A | 12/1996 | Ruby et al. | |
| 5,663,505 | A | 9/1997 | Nakamura | |
| 5,784,340 | A | 7/1998 | Kanai | |
| 5,814,922 | A | 9/1998 | Uchino et al. | |
| 5,873,153 | A | 2/1999 | Ruby et al. | |
| 5,996,407 | A * | 12/1999 | Hewitt | 73/290 V |
| 6,040,654 | A | 3/2000 | Le Letty | |
| 6,346,764 | B1 | 2/2002 | Boyd | |
| 6,362,559 | B1 | 3/2002 | Boyd | |
| 6,377,137 | B1 | 4/2002 | Ruby | |
| 6,462,631 | B2 | 10/2002 | Bradley et al. | |
| 6,469,597 | B2 * | 10/2002 | Ruby et al. | 333/187 |
| 6,472,954 | B1 | 10/2002 | Ruby et al. | |
| 6,507,983 | B1 | 1/2003 | Ruby et al. | |

(Continued)

FOREIGN PATENT DOCUMENTS

| | | |
|---|---|---|
| CA | 2268415 | 10/2000 |
| EP | 451533 | 10/1991 |

OTHER PUBLICATIONS

U.S. Appl. No. 11/604,478; Non-Final Office Action mailed on Oct. 16, 2008.

(Continued)

*Primary Examiner* — Shawki S Ismail
*Assistant Examiner* — Bryan Gordon

(57) ABSTRACT

An apparatus comprises a substrate and transducers disposed over the substrate, each of the transducers comprising a different resonance frequency. A transducer device comprises circuitry configured to transmit signals, or to receive signals, or both. The transducer device also comprises a transducer block comprising a plurality of piezoelectric ultrasonic transducers (PMUT), wherein each of the PMUTs; and an interconnect configured to provide signals from the transducer block to the circuitry and to provide signals from the circuitry to the transducer block.

11 Claims, 17 Drawing Sheets

(56) References Cited

U.S. PATENT DOCUMENTS

| | | | | |
|---|---|---|---|---|
| 6,667,566 | B2 | 12/2003 | Kim et al. | |
| 6,787,897 | B2 | 9/2004 | Geefay et al. | |
| 6,919,669 | B2 | 7/2005 | Bryant et al. | |
| 7,224,105 | B2 | 5/2007 | Onishi et al. | |
| 7,299,529 | B2 * | 11/2007 | Ginsburg | H03H 3/02 29/25.35 |
| 7,538,477 | B2 | 5/2009 | Fazzio et al. | |
| 7,579,753 | B2 | 8/2009 | Fazzio et al. | |
| 2002/0030424 | A1 | 3/2002 | Iwata | |
| 2005/0140247 | A1 * | 6/2005 | Lee | 310/320 |
| 2005/0194867 | A1 | 9/2005 | Kawakubo et al. | |
| 2005/0219040 | A1 * | 10/2005 | Dryer | 340/384.71 |
| 2007/0046396 | A1 * | 3/2007 | Huang | B06B 1/0292 333/186 |
| 2007/0082421 | A1 | 4/2007 | Minervini | |
| 2007/0270929 | A1 * | 11/2007 | Jacobus De Villiers | 607/149 |
| 2007/0279153 | A1 | 12/2007 | Ruby | |
| 2007/0284971 | A1 * | 12/2007 | Sano | H03H 9/02094 310/364 |
| 2008/0013405 | A1 * | 1/2008 | Moon et al. | 367/92 |
| 2008/0122317 | A1 * | 5/2008 | Fazzio | G01H 11/08 310/328 |
| 2008/0122320 | A1 | 5/2008 | Fazzio et al. | |
| 2008/0202239 | A1 * | 8/2008 | Fazzio | G01C 19/56 73/504.18 |

OTHER PUBLICATIONS

U.S. Appl. No. 11/604,478; Notice of Allowance and Fees Due mailed on Jun. 3, 2009.

U.S. Appl. No. 11/737,725; Non-Final Office Action mailed on Aug. 25, 2008.

U.S. Appl. No. 11/737,725; Notice of Allowance and Fees Due mailed on Apr. 21, 2009.

Reid, Robert P., et al. "Piezoelectric Microphone with On-Chip CMOS Circuits", Journal of Microelectromechanical Systems, vol. 2 No. 3, Sep. 1993, p. 111-120.

Loeppert, Peter V., et al. "SiSonic—The First Commercialized MEMS Microphone" Solid-State Sensors, Actuators, and Microsystems Workshop, Hilton Head Island, South Carolina, Jun. 4-8, 2006, p. 27-30.

Niu, Meng-Nian, et al. "Piezoelectric Bimorph Microphone Built on Micromachined Parylene Diaphragm" Journal of Microelectomechanical Systems, vol. 12 No. 6, Dec. 2003, p. 892-898.

* cited by examiner

MULTI-FREQUENCY ACOUSTIC ARRAY

CROSS-REFERENCE TO RELATED APPLICATIONS

The present application is related to commonly owned U.S. Pat. No. 7,538,477 to R. Shane Fazzio, et al, entitled TRANSDUCERS WITH ANNULAR CONTACTS and filed on Nov. 27, 2006; U.S. Pat. No. 7,538,477 to R. Shane Fazzio, et al. entitled MULTI-LAYER TRANSDUCERS WITH ANNULAR CONTACTS and filed on Apr. 19, 2007. The present application is a continuation-in-part of U.S. patent application Ser. No. 12/261,902 (U.S. Patent Application Publication 20100112965) to Osvaldo Buccafusca, et al., entitled METHOD AND APPARATUS TO TRANSMIT, RECEIVE AND PROCESS SIGNALS WITH NARROW BANDWIDTH DEVICES and filed on Oct. 30, 2008. The entire disclosures of the cross-referenced patents and patent application are specifically incorporated herein by reference.

BACKGROUND

Transducers are used in a wide variety of electronic applications. One type of transducer is known as a piezoelectric transducer. A piezoelectric transducer comprises a piezoelectric material disposed between electrodes. The application of a time-varying electrical signal will cause a mechanical vibration across the transducer; and the application of a time-varying mechanical signal will cause a time-varying electrical signal to be generated by the piezoelectric material of the transducer. One type of piezoelectric transducer may be based on bulk acoustic wave (BAW) resonators and film bulk acoustic resonators (FBARs). As is known, at least a part of the resonator device is suspended over a cavity in a substrate. This suspended area is usually referred as a membrane. As the membrane moves it translates a mechanical or acoustic perturbation to an electrical signal. In a similar manner, an electrical excitation is translated into an acoustical signal or a mechanical displacement.

Among other applications, piezoelectric transducers may be used to transmit or receive mechanical and electrical signals. These signals may be the transduction of acoustic signals, for example, and the transducers may be functioning as microphones (mics) and speakers and the detection or emission of ultrasonic waves. As the need to reduce the size of many components continues, the demand for reduced-size transducers continues to increase as well. This has lead to comparatively small transducers, which may be micromachined according to technologies such as micro-electromechanical systems (MEMS) technology, such as described in the related applications.

In many applications, there is a need to provide a transmit function or a receive function that comprises a comparatively high bandwidth transmitter, or receiver, or both. One application where higher bandwidth devices may be useful is in the transmission and reception of fast transition time signals. For example, an ideal square wave has an infinite slope at the leading a trailing edges of each signal. As should be appreciated by one skilled in the art, in the frequency domain such a signal comprises an infinite number of frequency components that are multiple of the fundamental frequency (harmonics). Realizable square waves have a large number of high frequency components with distributions around the harmonics. More complex signals have a frequency content that is not necessarily associated with harmonics. The frequency content of these higher complexity signals can be described by various types of mathematical decompositions such as Fourier, Laplace, Wavelet and others known to one of ordinary skill in the art. To transmit or receive these fast varying signals, the transmitter or receiver has to respond to the high frequency content. Thus, known transmitters and receivers require a high bandwidth to handle such signals.

While comparatively high bandwidth devices allow transmission and reception of signals have a broad range of frequencies, there are drawbacks to known broadband devices. For example, known high bandwidth devices are often more complex and more expensive to manufacture; they are more susceptible to noise limitations and often have a comparatively low quality (Q) factor, or simply Q. Thus, the gain of high bandwidth comes at the expense of price and performance.

What is needed, therefore, is an apparatus that overcomes at least the drawbacks of known transducers discussed above.

SUMMARY

In accordance with a representative embodiment, an apparatus comprises a substrate; and transducers disposed over the substrate, each of the transducers comprising a different resonance frequency.

In accordance with another representative embodiment, a piezoelectric ultrasonic transducer (PMUT) device comprises: a substrate; transducers disposed over the substrate, each of the transducers comprising a different acoustic resonance frequency. Each of the transducers comprises a first electrode, a second electrode and a piezoelectric layer between the first and second electrodes.

In accordance with another representative embodiment, A transducer device comprises circuitry configured to transmit signals, or to receive signals, or both. The transducer device also comprises a transducer block comprising a plurality of piezoelectric ultrasonic transducers (PMUT), wherein each of the PMUTs; and an interconnect configured to provide signals from the transducer block to the circuitry and to provide signals from the circuitry to the transducer block.

BRIEF DESCRIPTION OF THE DRAWINGS

The present teachings are best understood from the following detailed description when read with the accompanying drawing figures. The features are not necessarily drawn to scale. Wherever practical, like reference numerals refer to like features.

DEFINED TERMINOLOGY

As used herein, the terms 'a' or 'an', as used herein are defined as one or more than one.

In addition to their ordinary meanings, the terms 'substantial' or 'substantially' mean to with acceptable limits or degree to one having ordinary skill in the art. For example, 'substantially cancelled' means that one skilled in the art would consider the cancellation to be acceptable.

In addition to their ordinary meanings, the terms 'approximately' mean to within an acceptable limit or amount to one having ordinary skill in the art. For example, 'approximately the same' means that one of ordinary skill in the art would consider the items being compared to be the same.

DETAILED DESCRIPTION

In the following detailed description, for purposes of explanation and not limitation, representative embodiments disclosing specific details are set forth in order to provide a thorough understanding of the present teachings. Descriptions of known devices, materials and manufacturing methods may be omitted so as to avoid obscuring the description of the representative embodiments. Nonetheless, such devices, materials and methods that are within the purview of one of ordinary skill in the art may be used in accordance with the representative embodiments.

Figure 1:
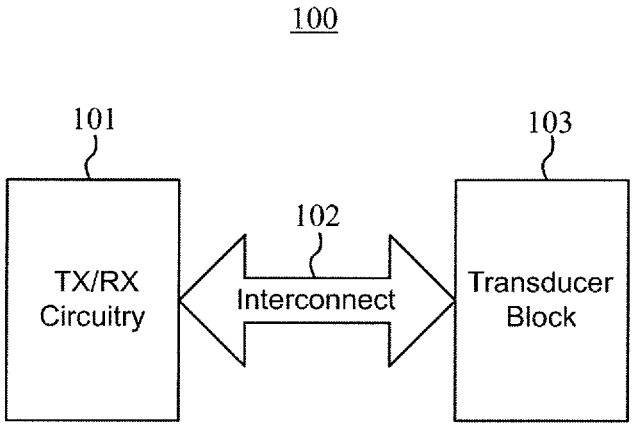
FIG. 1 shows a simplified block diagram of a transducer device in accordance with a representative embodiment.

FIG. 1 shows a simplified block diagram of a transducer device 100 in accordance with a representative embodiment. The transducer device 100 comprises transmit/receive circuitry 101, an interconnect 102 and a transducer block 103.

The transmit/receive circuitry 101 comprises components and circuits as described in the parent application to Buccafusca, et al. Notably, the transducer device 100 may be configured to operate in a transmit mode or in a receive mode, or in a duplex mode. As such, the transmit/receive circuitry 101 may be configured to provide an input signals to the transducer block 103 in a manner described in the parent application in the transmit mode; or may be configured to receive output signals from the transducer block 103 as described in the parent application is a receive mode; or may be configured to provide input signals to the transducer block 103 and receive signals from the transducer block 103 in a duplex mode. Generally, the transmit/receive circuitry 101 illustratively comprises a singled-ended, differential or common-mode implementation of digital and analog signal manipulation and conditioning, filtering, impedance matching, phase control, switching, and the like. This implementation can be realized with discrete components or integrated in a semiconductor chip.

The interconnect 102 comprises the electrical interconnection between the driver circuitry and the transducer block 103. The interconnect 102 may contain one or more signal paths and encompasses the various technologies such as wire bonding, bumping or any other joining or wiring technique.

As described more fully herein, the transducer block 103 comprises a single transducer configured to operate at more than one resonant frequency, or comprises a plurality of transducers, each operating at a particular resonant frequency.

The transmit/receive circuitry 101, the interconnect 102 and the transducer block 103 may be instantiated on a common substrate, or may be instantiated one or more individual components or a combination thereof. As will become clearer as the present description continues, the present teachings contemplate fabrication of the transducer device 100 in large-scale semiconductor processing on a common semiconductor substrate, or via individual chips on a common substrate, for example. Further packaging of the transducer device 100 is also contemplated using known methods and materials.

The embodiments described below relate to MEMs devices comprising transducers contemplated for use in the transducer block 103. In keeping with the teachings above, the MEMs devices may be provided on a dedicated substrate (e.g., as a stand-alone chip or package), or may be integrated into a substrate common to the interconnect 102, or the transmit/receive circuitry 101, or both.

Figure 2A:
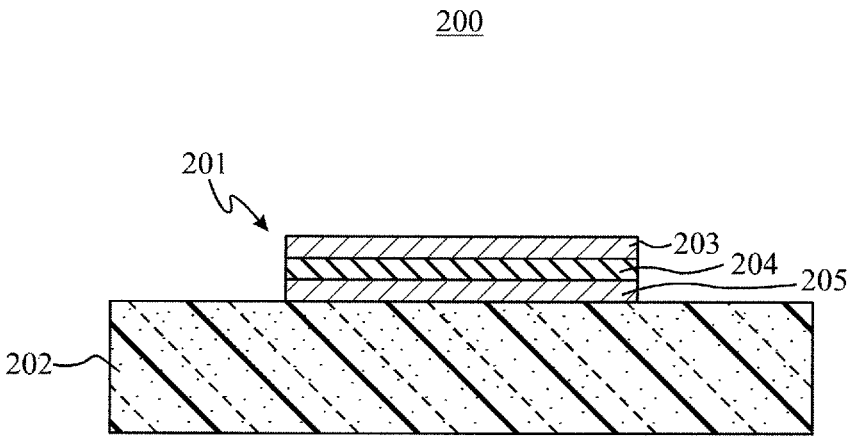
FIG. 2A shows a cross-sectional view of a MEMs transducer in accordance with a representative embodiment.

FIG. 2A shows a cross-sectional view of a MEMs device 200 in accordance with a representative embodiment. The MEMs device 200 comprises a transducer 201 disposed over a substrate 202. The transducer 201 comprises a first electrode 203, a piezoelectric element 204 and a second electrode 205. The transducer 201 may be one of the transducers provided in the transducer block 103, and the substrate 202 may be common to the plurality of transducers in the transducer block 103. Notably, a portion of each transducer 201 is provided over a cavity (not shown in FIG. 2A) in the substrate 202. Often, this portion of the transducer is referred to as a membrane. The membrane is configured to oscillate by flexing (i.e., in a flexure mode) over a substantial portion of the active area thereof.

Illustratively, the transducer 201 comprises one embodiment of a piezoelectric micromachined ultrasonic transducer (pMUT) described in accordance with the present teachings. PMUTs are illustratively based on film bulk acoustic (FBA) transducer technology or bulk acoustic wave (BAW) technology. As described more fully herein, a plurality of PMUTs in accordance with the representative embodiments may be provided over a single substrate. Moreover, in representative embodiments, the PMUTs are driven at a resonance condition, and thus may be film bulk acoustic resonators (FBARs). Regardless of the structure(s) of the transducer 201 selected, the transducer(s) 201 are contemplated for use in a variety of applications. These applications include, but are not limited to microphone applications, ultrasonic transmitter applications and ultrasonic receiver applications.

The piezoelectric element 204 of the representative embodiments may comprise one or more layers of piezoelectric material including AN, PZT ZnO or other suitable piezoelectric material that can be instantiated in a substantially thin film layer. The first and second electrodes 203, 205 comprise materials such as molybdenum, aluminum, copper, gold, platinum, tungsten, silver, titanium and other electrically conductive or partially conductive materials, their alloys and their combination. The first and second electrodes 203, 205 extend to contacts that allow interconnection to the driver circuitry. Moreover, the substrate 202 comprises a material selected for electrical, or thermal, or integration properties, or a combination thereof. Illustrative materials include silicon, compound semiconductors materials (such as Gallium-Arsenide, Indium-Phosphide, Silicon-Carbide, Cadmium Zinc Telluride, et cetera), glass, ceramic alumina suitably selected material that can be provided in wafer form.

Additional details of the transducer 201 implemented as a pMUT are described in the referenced applications to Fazzio, et al. Moreover, the transducer 201 may be fabricated according to known semiconductor processing methods and using known materials. Illustratively, the structure of the MEMs device 200 may be as described in one or more of the following U.S. Pat. No. 6,462,631 to Bradley, et al.; U.S. Pat. Nos. 6,377,137 and 6,469,597 to Ruby; U.S. Pat. No. 6,472,954 to Ruby, et al.; and may be fabricated according to the teachings of U.S. Pat. Nos. 5,587,620, 5,873,153 and 6,507,983 to Ruby, et al. The disclosures of these patents are specifically incorporated herein by reference. It is emphasized that the structures, methods and materials described in these patents are representative and other methods of fabrication and materials within the purview of one of ordinary skill in the art are contemplated.

Figure 2B:
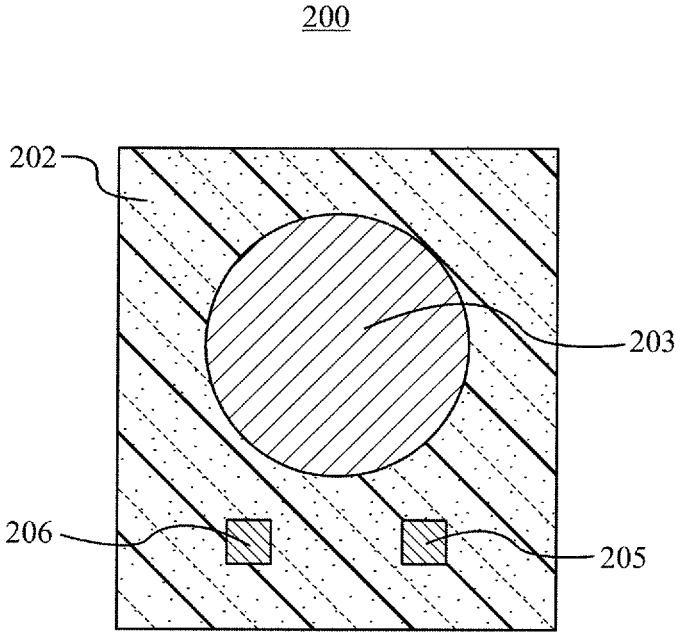
FIG. 2B shows a top view of the MEMs device in accordance with a representative embodiment.

FIG. 2B shows a top view of the MEMs device 200 in accordance with a representative embodiment. In the present embodiment, the first electrode 203 is substantially circular in shape. The circular shape is illustrative and it is emphasized that the first and second electrodes 203, 205 may be elliptical, rectangular and any other regular or irregular polygonal shape. Contacts 206, 207 are configured to contact a respective one of the first and second electrodes 203, 205. Illustratively, the contacts provide the interconnection to the transmit/receive circuitry 101, and depending on the mode of operation, are configured to provide the drive signal(s) to the MEMs device 200 or to provide the receive signal from the MEMs device 200, or both.

Figure 3:
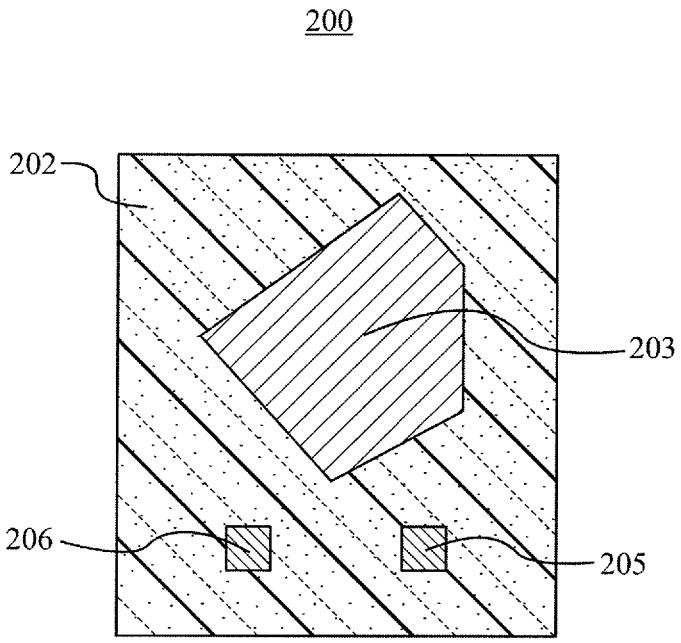
FIG. 3 shows the MEMs device in accordance with another representative embodiment.

FIG. 3 shows the MEMs device 200 in accordance with another representative embodiment. In the present embodiment, the first electrode 203 and the second electrode (not shown in FIG. 3) are apodized. The apodization of first and second electrodes 203, 205 improves the quality factor (Q) of the MEMs device 200 by reducing losses to transverse modes. Apodization is described for example in commonly owned U.S. patent application Ser. No. 11/443,954 entitled "PIEZOELECTRIC RESONATOR STRUCTURES AND ELECTRICAL FILTERS" to Richard C. Ruby. The disclosure of this application is specifically incorporated herein by reference.

As described above, contacts 206, 207 are configured to contact a respective one of the first and second electrodes 203, 205. Illustratively, the contacts provide the interconnection to the transmit/receive circuitry 101, and depending on the mode of operation, are configured to provide the drive signal (s) to the MEMs device 200 or to provide the receive signal from the MEMs device 200, or both.

Figure 4:
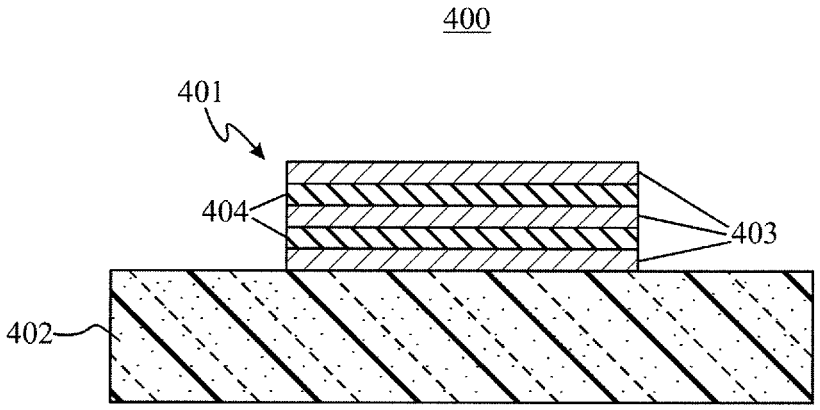
FIG. 4 shows a MEMs device in cross-section in accordance with a representative embodiment.

FIG. 4 shows a MEMs device 400 in cross-section in accordance with a representative embodiment. The MEMs device comprises a transducer 401 disposed over a substrate 402. The transducer 401 comprises electrodes 403 and piezoelectric elements 404 between respective electrodes to for a two layer stack. Notably, additional electrodes and piezoelectric elements can be provided for additional stacks. The stacks can be electrically connected in series or in parallel, such as described in the referenced application to Fazzio, et al., entitled MULTI-LAYER TRANSDUCERS WITH ANNULAR CONTACTS. The selective series connection of the stacks usefully cause the phase of the flexure mode of the individual stacks to be substantially the same in order to increase the amplitude of the flexing of the transducer 401 and thus the transducer output. Parallel connections can be made to provide noise cancellation, for example.

Figure 5A:
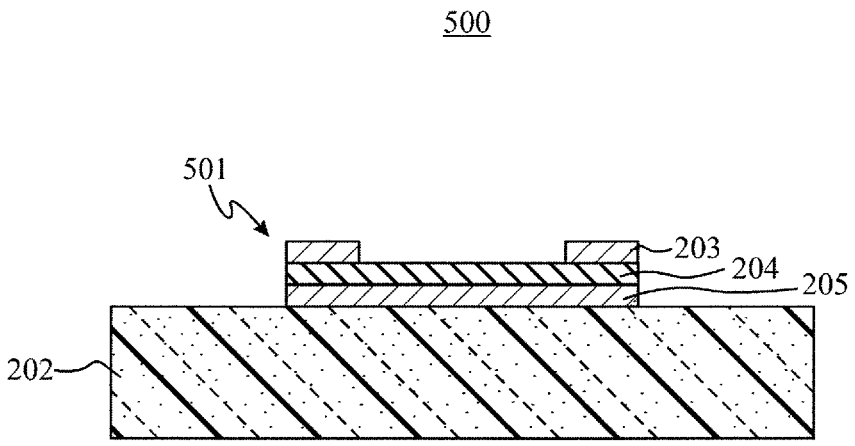
FIG. 5A shows a MEMs device in cross-section in accordance with a representative embodiment.
Figure 5B:
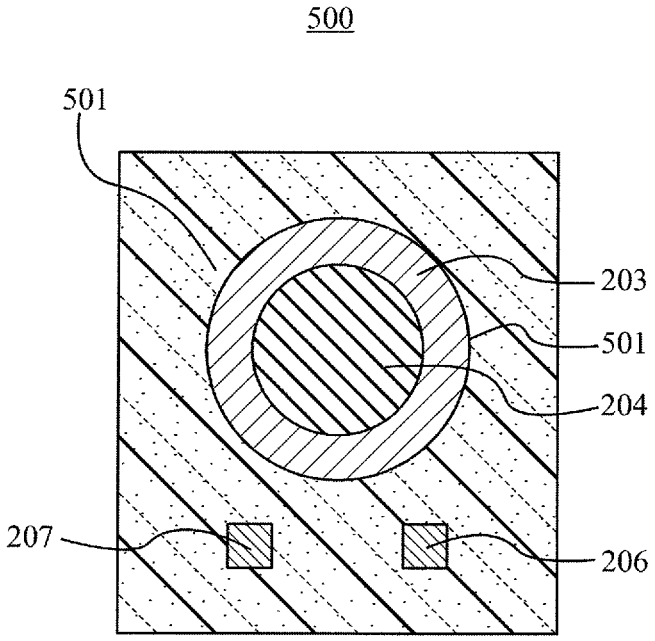
FIG. 5B shows a top-view of a MEMs in accordance with a representative embodiment.

FIG. 5A shows a MEMs device 500 in cross-section in accordance with a representative embodiment. The MEMs device comprises a transducer 501 disposed over a substrate 502. The transducer 501 comprises first and second electrodes 203, 205 and a piezoelectric element 204 between the first and second electrodes 203, 205. Notably, and as shown more clear in the top view in FIG. 5B, the first electrode 203 is disposed annularly over the piezoelectric element 204. This ring-like shape in contrast the second electrode 205, which is substantially circular in shape. As noted before the circular shape of either the ring-like shape of the first electrode 203 or the circular shape of the second electrode 205 is merely illustrative, and other shapes, such as elliptical shapes, with the first electrode 203 being annular and elliptical and the second electrode 205 being areally an ellipse are contemplated. Further details including various embodiments of annularly disposed electrodes and their electrical connections are described in the referenced application to Fazzio, et al., entitled MULTI-LAYER TRANSDUCERS WITH ANNULAR CONTACTS.

Figure 6A:
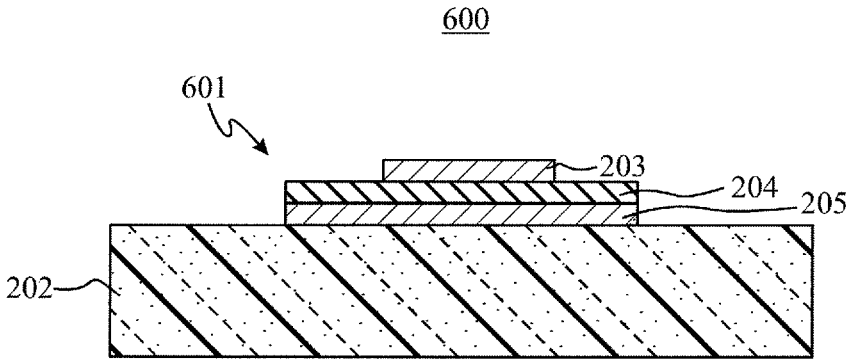
FIG. 6A shows a MEMs device in cross-section in accordance with a representative embodiment.
Figure 6B:
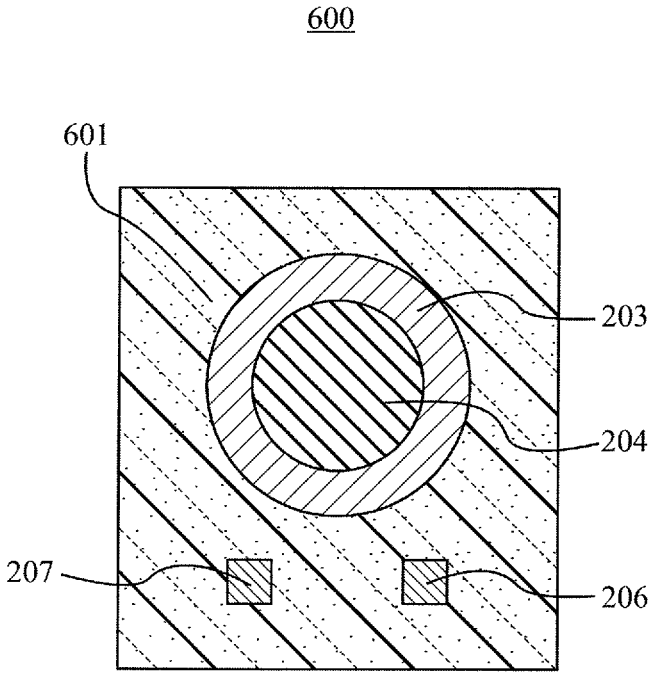
FIG. 6B shows a top view of a MEMs device in accordance with a representative embodiment.

FIG. 6A shows a MEMs device 600 in cross-section in accordance with a representative embodiment. The MEMs device 600 comprises a transducer 601 disposed over a substrate 602. The transducer 601 comprises first and second electrodes 203, 205 and a piezoelectric element 204 between the first and second electrodes 203, 205. Notably, and as shown more clear in the top view in FIG. 6B, the first electrode 203 is substantially circular have an areal dimension that is less than the areal dimension of the piezoelectric element 204 and the second electrode 205. Illustratively, the piezoelectric element 204 and the second electrode 205 are also substantially circular, and have substantially identical areal dimensions. As described above, the circular shapes of the electrodes and the piezoelectric element may be other than circular.

Figure 7:
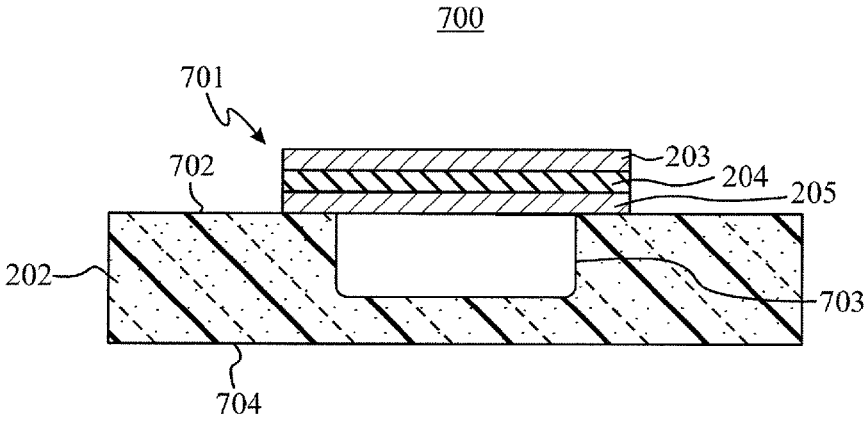
FIG. 7 shows a MEMs device in cross-section in accordance with a representative embodiment.

FIG. 7 shows a MEMs device 700 in cross-section in accordance with a representative embodiment. The MEMs device 700 comprises a transducer 701 disposed over a substrate 202. The transducer 701 comprises first and second electrodes 203, 205 and a piezoelectric element 204 between the first and second electrodes 203, 205. The shape of the first and second electrodes 203, 205 and the piezoelectric element 204 may be as described above in connection with representative embodiment. The MEMs device 700 comprises a cavity 703 with an opening at a first surface 702 of the substrate 202, but not extending through a second surface 704 of the substrate. The cavity 703 provides damping of the transducer 701, and thus provides a damped resonator structure. As discussed above, the portion of the transducer 701 that is suspended over the cavity 703 comprises the membrane.

The cavity 703 may be formed in much the same manner as a known 'swimming pool' in an FBAR, and as disclosed in certain referenced patents above. However, the dimensions of the cavity are controlled to manipulate the acoustic response of the transducer 701. Generally, the dimensions of the cavity 703 are selected to manipulate the acoustic properties of the transducer. Usefully the cavity 703 has a depth of $\lambda/4$, where $\lambda$ is the wavelength of the acoustic wave in air. Selection of a cavity depth of $\lambda/4$ fosters vibration of the membrane vibration and produce a comparatively higher Q-factor and increased efficiency in the transducer 701.

Figure 8A:
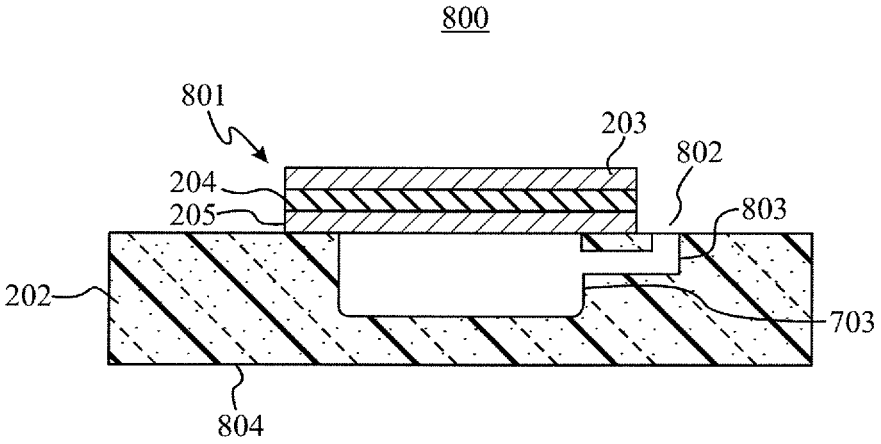
FIG. 8A shows a MEMs device in cross-section in accordance with a representative embodiment.
Figure 8B:
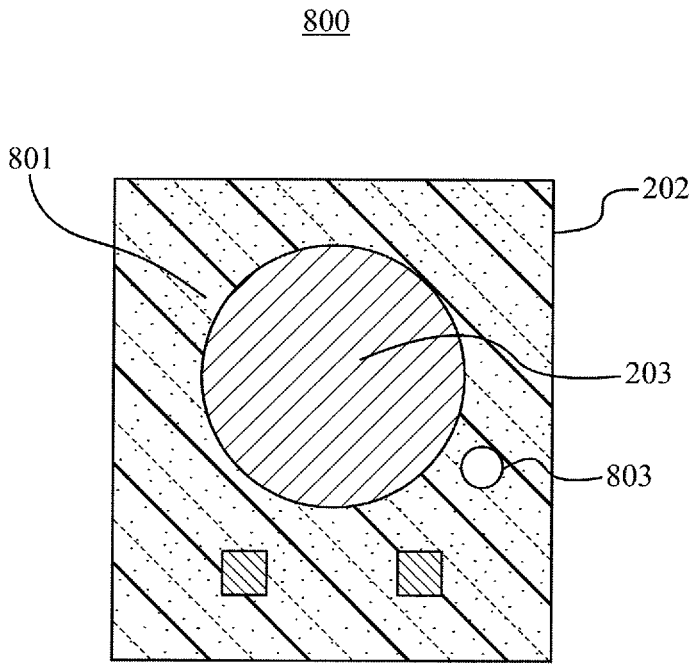
FIG. 8B shows a top view of the MEMs device depicted in FIG. 8A.

FIG. 8A shows a MEMs device 800 in cross-section in accordance with a representative embodiment. FIG. 8B shows a top view of the MEMs device depicted in FIG. 8A. The MEMs device 800 comprises a transducer 801 disposed over a substrate 202. The transducer 801 comprises first and second electrodes 203, 205 and a piezoelectric element 204 between the first and second electrodes 203, 205. The shape of the first and second electrodes 203, 205 and the piezoelectric element 204 may be as described above in connection with representative embodiments. The MEMs device 800 comprises cavity 703 with vent 803 at a first surface 802 of the substrate 202, but not extending through a second surface 804 of the substrate. As discussed above, the portion of the transducer 801 that is suspended over the cavity 703 comprises the membrane.

The vent 803 is formed between the cavity 703 and the first surface 802 to promote pressure equalization between the cavity 703 and the ambient of the MEMs device 800. As noted previously, the cavity 703 may be formed in much the same manner as a known 'swimming pool' in an FBAR, and as disclosed in certain referenced patents above. Again, the dimensions of the cavity are controlled to manipulate the acoustic response of the transducer 801. The vent 803 is created by one of a variety of wet or dry etching methods known in the art, and is selected based on substrate material, aspect ratio and overall compatibility with overall processing steps used in fabricating the MEMs device 800.

Figure 9A:
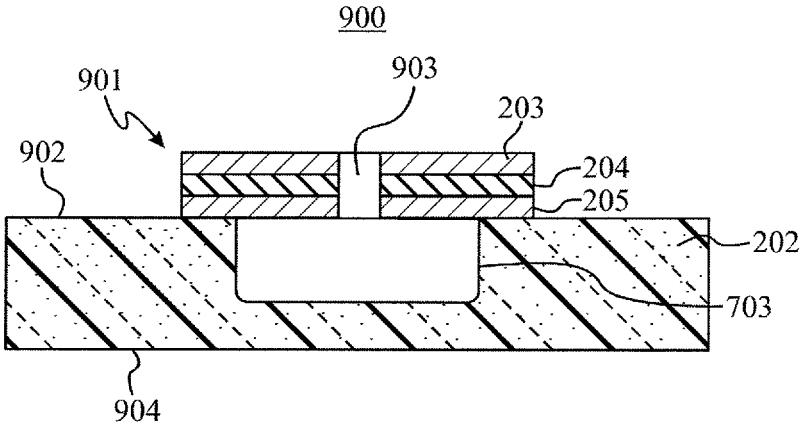
FIG. 9A shows a MEMs device in cross-section in accordance with a representative embodiment.
Figure 9B:
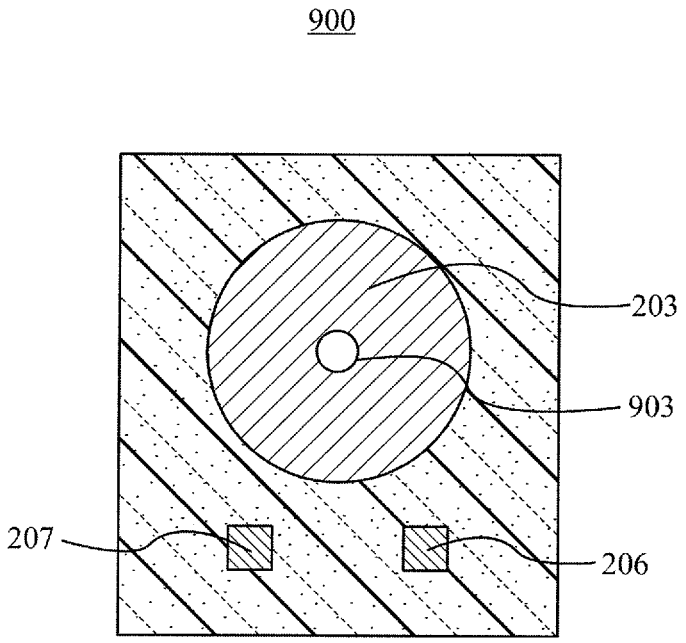
FIG. 9B shows a top view of a MEMs device in accordance with a representative embodiment.

FIG. 9A shows a MEMs device 900 in cross-section in accordance with a representative embodiment. The MEMs device 900 comprises a transducer 901 disposed over the substrate 202. The transducer 901 comprises first and second electrodes 203, 205 and the piezoelectric element 204 between the first and second electrodes 203, 205. The first and second electrodes 203, 205 and the piezoelectric element 204 are successively stacked and annular in shape about a vent 903 that extends through the first and second electrodes 203, 205 and the first surface 902 of the substrate 202, and into the cavity 703. The cavity 703 does not extend through a second surface 904 of the substrate 202. Notably, the annular or ring-shape of the first and second electrodes 203, 205 and the piezoelectric element 204 are shown more clearly in FIG. 9B. The vent 903 promotes pressure equalization between the cavity 703 and the ambient of the MEMs device 900. The vent 903 fosters pressure equalization between the sides (front and back) of the membrane. As noted previously, the cavity 703 may be formed in much the same manner as a known 'swimming pool' in an FBAR, and as disclosed in certain referenced patents above. Again, the dimensions of the cavity are controlled to manipulate the acoustic response of the transducer 801. The vent 903 is created by one of a variety of wet or dry etching methods known in the art, and is selected based on substrate material, aspect ratio and overall compatibility with overall processing steps used in fabricating the MEMs device 800.

Figure 10:
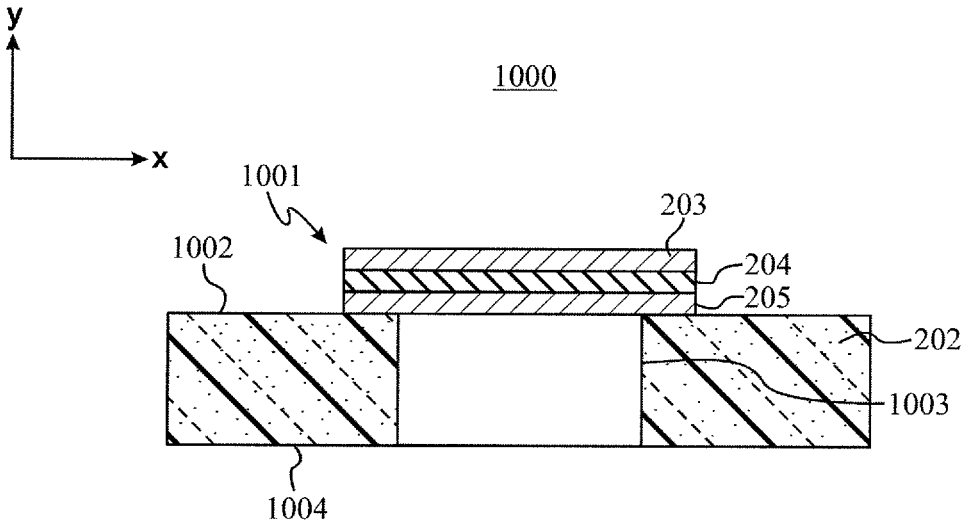
FIG. 10 shows a MEMs device in cross-section in accordance with a representative embodiment.

FIG. 10 shows a MEMs device 1000 in cross-section in accordance with a representative embodiment. The MEMs device 1000 comprises a transducer 1001 disposed over the substrate 202. The transducer 1001 comprises first and second electrodes 203, 205 and the piezoelectric element 204 between the first and second electrodes 203, 205. The first and second electrodes 203, 205 and the piezoelectric element 204 may be one of a variety of shapes, such as described in connection with respective embodiments above. However, there is no vent included in the MEMs device 1000 at least because an opening 1003 is provided from a first surface 1002 through the substrate 202 and through a second surface 1004. Like the cavity 703 described previously, the opening 1003 is disposed beneath the second electrode 205. The opening 1003 may be formed in much the same manner as a known 'swimming pool' in an FBAR, and as disclosed in certain referenced patents above. The dimensions of the opening 1003 are controlled to manipulate the acoustic response of the transducer 1001. For emission on both sides of the membrane of the transducer 1001, the opening 1003 is selected to be comparatively large; illustratively on approximately a diameter of the membrane. For top side emission, the diameter is selected to provide the necessary acoustic damping to manipulate Q (the smaller the diameter, the higher the acoustic resistance and the smaller the Q). The placement of the opening 1003 is, in both cases, centered with the membrane The opening 1003 provides pressure equalization of both sides of the transducer 1001 thereby eliminating the need for use of a vent. Moreover, the transducer 1001 may transmit and receive acoustic waves through opening 1003, as well as from the opposing side of the transducer 1001 (i.e., at the interface of the first electrode 203 and the ambient). Thus, the transducer 1001 can function in both the +y and the −y directions according to the coordinate system shown in FIG. 10.

The MEMs devices described in connection with the representative embodiments commonly comprise a transducer that comprises a membrane that deflects or vibrates due to acoustic pressure; thus the response is a flexure mode. Varying the geometry (size, shape and thickness) of the transducers allow the tuning to different frequencies.

Figure 11:
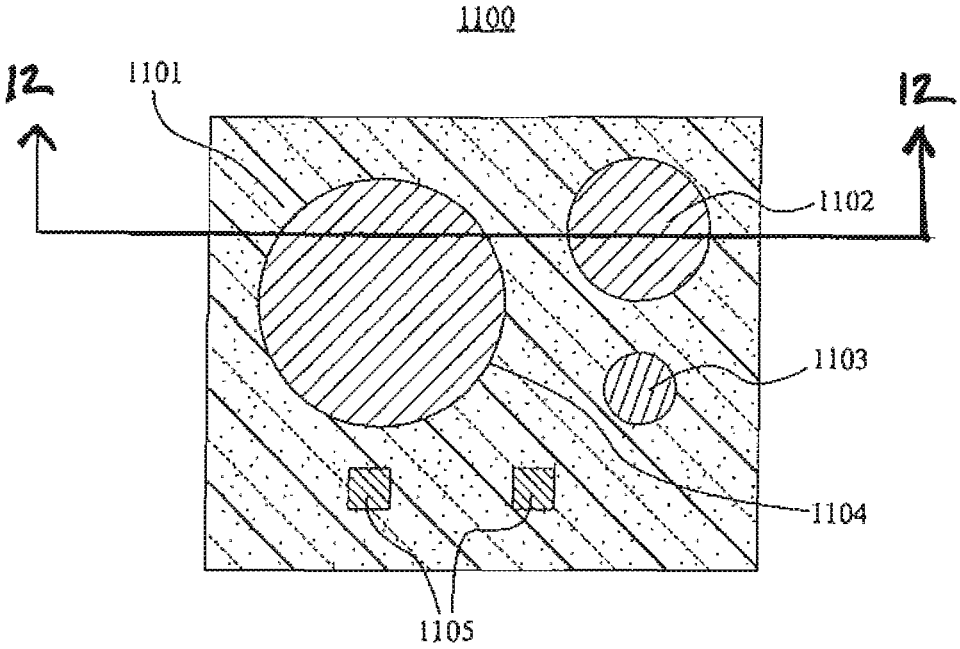
FIG. 11 shows a top view of a MEMs device in accordance with a representative embodiment.
Figure 12:
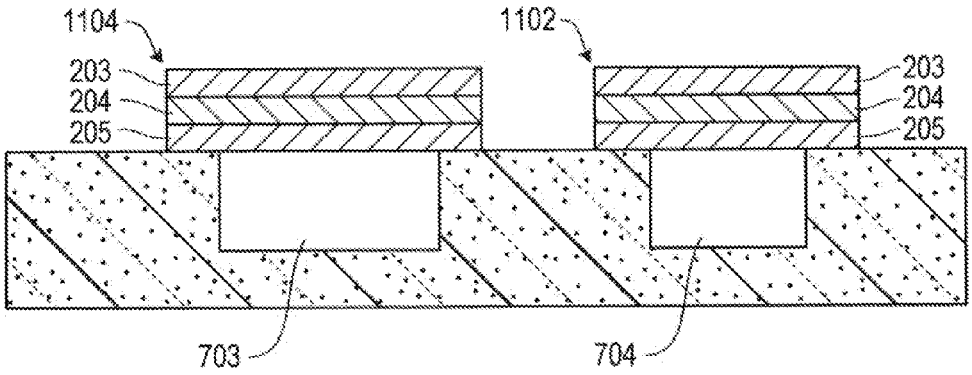
FIG. 12 shows a cross-sectional view of the MEMs device depicted in FIG. 11.

FIG. 11 shows a top view of a MEMs device 1100 in accordance with a representative embodiment. The MEMs device 1100 comprises a plurality of transducers 1102, 1103, 1104 forming an array of transducers. The array of transducers may be provided on a common substrate, forming a transducer block. The transducer block may then be connected to circuitry (e.g., a driver circuit) suitable for signal transmission or reception, or both. Alternatively, the MEMs device 1100 may comprise a plurality of individual transducer not provided on a common substrate, and connected to circuitry. Regardless of whether the transducers are provided on a common substrate as a transducer block, or individual transducers, the transducers of the array of the MEMs device 1100 may be one or more of the transducers described above in connection with representative embodiment. Notably, while in some embodiments the transducers 1102, 1103, 1104 are of the same or similar structure, this is not required. For example, one transducer may be an apodized structure such as described in connection with the embodiments of FIG. 3, while others may have circular or annular electrodes as described in connection with embodiments of FIG. 1, 4, 5A or 6A, for example. Moreover, vents and openings as described above may be implemented in one or more of the transducers 1102, 1103, 1104. Finally, the implementation of three transducers in the array is merely illustrative, and more or fewer transducers may be provided in the MEMs device 1100. Incidentally, FIG. 12 shows a cross-section of the MEMs device 1100 of FIG. 11 of a representative embodiment including transducers 1104 and 1102 respectively over cavities 703 and 704, and each respectively having a stack including a first electrode, a piezoelectric element and a second electrode.

While the transducers 1102, 1103, 1104 share certain common characteristics, their resonance condition and thereby their resonance frequencies are generally not the same. Rather, each transducer 1102, 1103, 1104 of the array can be engineered to operate in different acoustic frequencies selected to modify the frequency response.

As would be appreciated by one of ordinary skill in the art, the parameters of the transducers 1102, 1103,1104 that impact the characteristic frequency depend on (among other factors) the thickness of the layers of the transducer stack and the diameter of the membrane. In a representative embodiment, different transducer frequencies can be effected by selecting the thickness of the electrodes and piezoelectric layers of each transducer to be substantially the same, but the diameter of the membranes to be different. The devices in the array could be driven independently or simultaneously as described in the filed application to Buccafusca, et al., and may be interconnected in series and/or in parallel.

In one representative embodiment, the transducers 1102, 1103 and 1104 for a harmonic array. The transducers 1102, 1103, 1104 are selected to have different sizes, or shapes, or both as noted above to improve the harmonic emission. Notably, because each transducer 1102, 1103 and 1104 transmit at its particular resonance frequency, in order to transmit additional frequency content it is necessary to add more transducers at the desired frequency.

In operation, a transducer block comprising a plurality of transducers 1102, 1103, 1104 are provided on a common substrate, or a plurality of individual transducer are provided to for the array. In a representative embodiment, the transducers 1102, 1103, 1104 are the connected to transmit circuitry or receive circuitry, or both, such as described in the parent application entitled "METHOD AND APPARATUS TO TRANSMIT, RECEIVE AND PROCESS SIGNALS WITH NARROW BANDWIDTH DEVICES." The transducers 1102, 1103, 1104 may be interconnected in series and/or in parallel. In keeping with the description of the representative embodiments, the sizes of the emitters can be selected to match the fundamental and the odd harmonic frequencies to reproduce better square waves in the time domain. It is emphasized that the transmit/receive circuitry described in this application is merely illustrative, and use of other transmit and receive circuitry is contemplated.

In view of this disclosure it is noted that the MEMs devices, transducers and apparatuses can be implemented in a variety of materials, variant structures, configurations and topologies. Moreover, applications other than small feature size transducers may benefit from the present teachings. Further, the various materials, structures and parameters are included by way of example only and not in any limiting sense. In view of this disclosure, those skilled in the art can implement the present teachings in determining their own applications and needed materials and equipment to implement these applications, while remaining within the scope of the appended claims.

The invention claimed is:

1. An apparatus, comprising:

a substrate; and transducers disposed over the substrate, each of the transducers being configured to operate at a different resonance frequency, wherein at least one of the transducers is disposed over a cavity and comprises a vent between the cavity and an opposing surface of the transducer, and the vent is configured to substantially equalize a pressure between the cavity and an ambient environment to the opposing surface, wherein the transducer frequencies are selected in combination to transmit a substantially square wave output signal, or to receive a substantially square wave input signal.

2. An apparatus as claimed in claim 1, wherein each of the transducers comprises a first electrode, a second electrode and a piezoelectric layer between the first and second electrodes.

3. An apparatus as claimed in claim 1, wherein the vent extends through the transducer to the cavity.

4. A piezoelectric ultrasonic transducer (PMUT) device, comprising:

a substrate; and transducers disposed over the substrate, each of the transducers being configured to operate at a different acoustic resonance frequency, wherein each of the transducers comprises a first electrode, a second electrode and a piezoelectric layer between the first and second electrodes, wherein the resonance frequencies are selected in combination to transmit a substantially square wave output signal, or to receive a substantially square wave input signal.

5. A PMUT as claimed in claim 4, wherein a portion of each transducer is provided over a cavity in the substrate, wherein the portion of the transducer comprises a membrane.

6. A PMUT as claimed in claim 5, wherein at least one of the transducers further comprises a vent between the cavity and an opposing surface of the transducer, and configured to substantially equalize a pressure between the cavity and an ambient to the opposing surface.

7. A PMUT as claimed in claim 6, wherein at least one of the transducers further comprises a vent that extends through the transducer to the cavity.

8. A transducer device, comprising:

circuitry configured to transmit signals, or to receive signals, or both;

a transducer block comprising a plurality of piezoelectric ultrasonic transducers (PMUT) disposed over the substrate, each of the transducers being configured to operate at a different resonance frequency, wherein at least one of the PMUTs is disposed over a cavity and comprises a vent between the cavity and an opposing surface of the PMUT, and the vent is configured to substantially equalize a pressure between the cavity and an ambient environment to the opposing surface; and an interconnect configured to provide signals from the transducer block to the circuitry and to provide signals from the circuitry to the transducer block, wherein the resonance frequencies are selected in combination to transmit a substantially square wave output signal, or to receive a substantially square wave input signal.

9. A transducer device as claimed in claim 8, wherein each of the PMUTs is configured to operate at a different acoustic resonance frequency.

10. A transducer device as claimed in claim 9, wherein each of the PMUTs are provided over a common substrate.

11. A transducer device as claimed in claim 9, wherein each of the PMUTs is separate from the other PMUTs.

* * * * *